United States Patent [19]

Mulcahy

[11] Patent Number: 5,011,528

[45] Date of Patent: Apr. 30, 1991

[54] PUMPING LIQUID METALS

[75] Inventor: Joseph A. Mulcahy, Brooklin, Canada

[73] Assignee: J. Mulcahy Enterprises Inc., Whitby, Canada

[21] Appl. No.: 535,164

[22] Filed: Jun. 8, 1990

[51] Int. Cl.[5] ..... C22B 4/00

[52] U.S. Cl. ..... 75/10.16; 75/708; 417/50; 222/591

[58] Field of Search ..... 75/10.16, 708, 10.14, 75/10.15; 266/237; 373/142; 417/50; 164/500, 499; 222/591

[56] References Cited

U.S. PATENT DOCUMENTS 3,695,334 10/1972 Khripkov et al. ..... 164/499

*Primary Examiner*—Melvyn J. Andrews

*Attorney, Agent, or Firm*—Sim & McBurney

[57] ABSTRACT

Liquid metals are centrifugally pumped from a static container without the necessity for employing a mechanical impeller. A powerful rotating magnetic field surrounding the static container causes the metal to be rotated vigorously and the velocity head so created is converted in a volute shaped head into vertical motion to the desired delivery point.

6 Claims, 1 Drawing Sheet

PUMPING LIQUID METALS

FIELD OF INVENTION

The present invention relates to the elevating of liquid metals.

BACKGROUND TO THE INVENTION

In the processing of liquid metals, it often is necessary to elevate the liquid metal from one location to another. Such elevation is conventionally carried out by linear induction machines or mechanical impeller pumps.

Such linear induction systems employ open troughs which are subject to oxidation as well as permitting a head of only about one meter. The liquid metal is not pressurized and hence transport stops immediately outside the magnetic zone.

Circular linear motors have been employed to elevate liquid metals in tubes with the limitation that the velocity can be induced only in a limited outside peripheral area of the tube, causing a reverse flow down the center. In addition, the velocity heads created are very low.

SUMMARY OF INVENTION

In accordance with the present invention, a novel method of elevating a liquid metal from an enclosed container is provided which overcomes the prior art problems noted above, by eliminating exposure of the liquid metal to atmosphere eliminating the need for seals and mechanical devices and by significantly increasing the head attainable.

In the present invention, a rotating electromagnetic field is provided surrounding the container in which the liquid metal, such as molten iron or steel, is enclosed. Such rotating electromagnetic field is of such an intensity as to rotate the liquid metal with sufficient vigor as to deliver the liquid metal from the enclosed zone to the desired delivery point along an enclosed path.

The rotating magnetic field may be provided in any desired manner. One convenient manner uses series of electromagnetic coils surrounding the vessel through which electric current is sequentially passed.

DESCRIPTION OF PREFERRED EMBODIMENT

Figure 1:
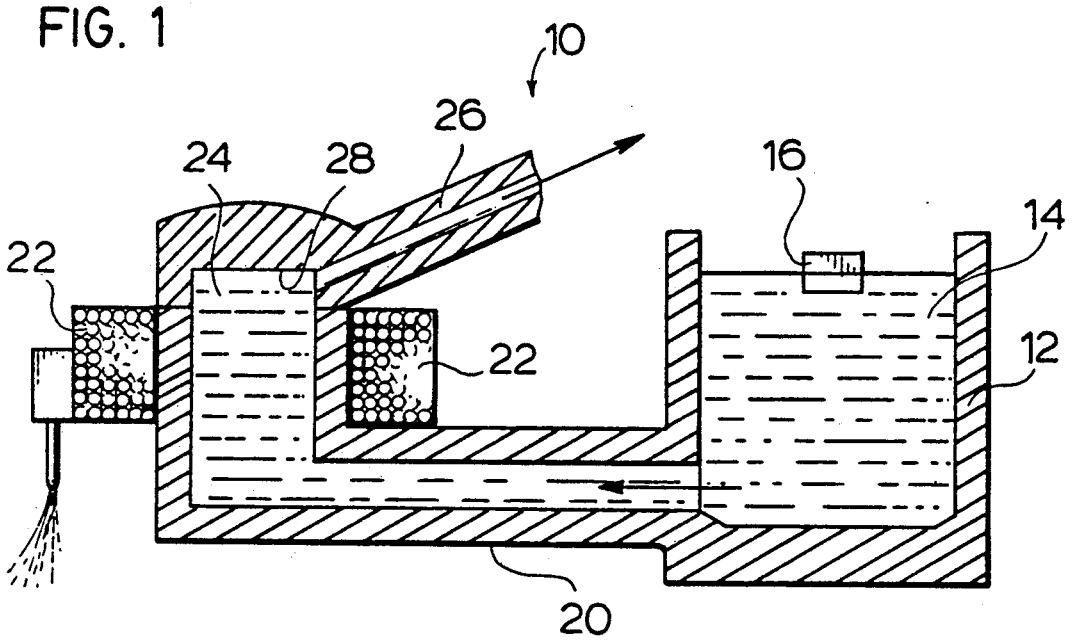
FIG. 1 is a schematic view of an apparatus for elevating a liquid metal in accordance with one embodiment of the invention.
Figure 2:
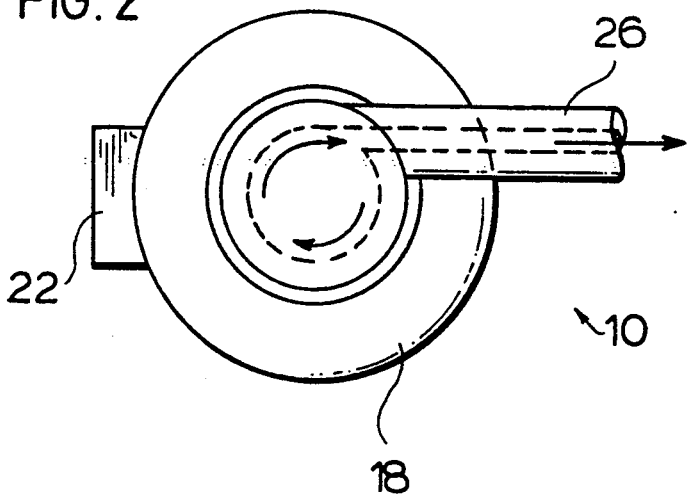
FIG. 2 is a plan view of a portion of the apparatus of FIG. 1.

Referring to the drawings, an apparatus 10 comprises an entry tundish 12 containing a body 14 of liquid metal, such as molten iron or steel, which may have a level detector 16 to control the liquid level in the tundish 12.

The tundish 12 is connected to an enclosed container 18 by a horizontal passage 20 for the passing of liquid metal from the tundish 12 to the container 18. The container 18, which is cylindrical in shape, is surrounded by stirring coils 22 which, by the passage of an electrical current therethrough, causes a body of liquid metal 24 in the container 18 to be rotated.

An upwardly-inclined delivery pipe 26 is arranged tangentially with the container 18 adjacent its head 28 to enable liquid metal to be transported from the enclosed container to a desired delivery point.

The magnetic coils 22 produce a powerful rotating magnetic field, generally with a strength in the range of about 500 to about 2000 Gauss with a frequency of rotation from about 5 to about 400 Hertz, which, in turn causes the body of liquid metal 24 to rotate vigorously, creating a velocity head, which is converted in the head 28, which may be in the form of a volute-shaped head or pressure cap, into vertical motion as the liquid metal enters the pipe 26.

Since the container 24 is wholly enclosed, the liquid metal does not become exposed to atmosphere and no seals or mechanical devices are required.

SUMMARY OF DISCLOSURE

In summary of this disclosure, the present invention provides a novel manner of elevating liquid metals from one location to another by effecting centrifugal pumping by employing a strong rotating magnetic field. Modifications are possible within the scope of this invention.

What is claim is:

1. A method of elevating an electromagnetic liquid metal from enclosed zone to a location above said enclosed zone, which comprises:

feeding said electromagnetic liquid metal to said enclosed zone to fill and maintain said enclosed zone substantially filled with said electromagnetic liquid metal, forming a magnetic field rotating around said enclosed zone of sufficient intensity to cause said liquid to rotate about an axis of rotation, providing an upwardly-inclined enclosed path extending from said enclosed zone offset from said axis of rotation to said location, and effecting said rotation of said liquid metal so as to generate sufficient velocity to deliver said liquid metal from said enclosed zone to said location along said enclosed path.

2. The method of claim 1 wherein said liquid metal is molten iron or steel.

3. The method of claim 2 wherein said rotating magnetic field is an electromagnetic field.

4. The method of claim 1 wherein said magnetic field has a strength of about 500 to about 2000 Gauss.

5. The method of claim 4 wherein said magnetic field has a frequency of about 5 to about 400 Hertz.

6. The method of claim 5 wherein said enclosed zone is cylindrical, said magnetic field is produced by a plurality of electromagnetic coils arranged around the exterior of the cylindrical enclosed zone, and said liquid metal is electromagnetic.

* * * * *